US012624603B2

(12) United States Patent
Lee et al.

(10) Patent No.: US 12,624,603 B2
(45) Date of Patent: May 12, 2026

(54) METHODS FOR REAL-TIME OPTIMIZATION OF COILED TUBING CLEANOUT OPERATIONS USING DOWNHOLE PRESSURE SENSORS

(71) Applicant: SCHLUMBERGER TECHNOLOGY CORPORATION, Sugar Land, TX (US)

(72) Inventors: Dongkeun Lee, Sugar Land, TX (US); Philippe Michel Jacques Tardy, Sugar Land, TX (US); Pavel Spesivtsev, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/101,951

(22) PCT Filed: Aug. 9, 2023

(86) PCT No.: PCT/US2023/029801
§ 371 (c)(1),
(2) Date: Feb. 7, 2025

(87) PCT Pub. No.: WO2024/035758
PCT Pub. Date: Feb. 15, 2024

(65) Prior Publication Data

US 2026/0009299 A1 Jan. 8, 2026

Related U.S. Application Data

(60) Provisional application No. 63/370,876, filed on Aug. 9, 2022.

(51) Int. Cl.
*E21B 21/08* (2006.01)
*E21B 7/00* (2006.01)
(Continued)

(52) U.S. Cl.
CPC ..... *E21B 21/08* (2013.01); *E21B 44/00* (2013.01); *E21B 47/06* (2013.01); *E21B 7/00* (2013.01);
(Continued)

(58) Field of Classification Search
CPC ..... E21B 21/08; E21B 44/00; E21B 47/06; E21B 7/00; E21B 19/22; E21B 47/00; E21B 47/135; E21B 2200/20; E21B 2200/22
(Continued)

(56) References Cited

U.S. PATENT DOCUMENTS

2007/0277975 A1 12/2007 Lovell
2008/0308272 A1 12/2008 Thomeer
(Continued)

FOREIGN PATENT DOCUMENTS

WO 2021086200 A1 5/2021

OTHER PUBLICATIONS

International Search Report and Written Opinion of International Patent Application No. PCT/US2023/029801 dated on Dec. 5, 2023, 10 pages.

*Primary Examiner* — Peter J Macchiarolo
*Assistant Examiner* — John M Royston
(74) *Attorney, Agent, or Firm* — Jeffrey D. Frantz

(57) ABSTRACT

Systems and methods presented herein facilitate coiled tubing cleanout operations, and generally relate to estimating reservoir pressure prior to the coiled tubing cleanout operations (e.g., while the wellbore is shut-in). For example, a method includes acquiring, via one or more downhole sensors of a coiled tubing system at least partially disposed within a wellbore, downhole data of the coiled tubing system; identifying, via a processing and control system, a density profile of fluids disposed within the wellbore based
(Continued)

at least in part on the acquired downhole data; interpreting, via the processing and control system, the density profile of the fluids disposed within the wellbore; and estimating, via the processing and control system, a reservoir pressure of a reservoir through which the wellbore extends based at least in part on the interpreted density profile of the fluids disposed within the wellbore.

14 Claims, 8 Drawing Sheets

(51) Int. Cl.

| | |
|---|---|
| ***E21B 19/22*** | (2006.01) |
| ***E21B 44/00*** | (2006.01) |
| ***E21B 47/00*** | (2012.01) |
| ***E21B 47/06*** | (2012.01) |
| ***E21B 47/135*** | (2012.01) |

(52) U.S. Cl.
CPC ..... *E21B 19/22* (2013.01); *E21B 47/00* (2013.01); *E21B 47/135* (2020.05); *E21B 2200/20* (2020.05); *E21B 2200/22* (2020.05)

(58) Field of Classification Search
USPC ..... 73/152.22
See application file for complete search history.

(56) References Cited

U.S. PATENT DOCUMENTS

| | | | | |
|---|---|---|---|---|
| 2011/0288843 | A1 | 11/2011 | Weng | |
| 2015/0233239 | A1* | 8/2015 | Wang | E21B 47/09 166/252.5 |
| 2016/0208600 | A1 | 7/2016 | Gisolf | |

* cited by examiner

METHODS FOR REAL-TIME OPTIMIZATION OF COILED TUBING CLEANOUT OPERATIONS USING DOWNHOLE PRESSURE SENSORS

CROSS-REFERENCE TO RELATED APPLICATION

This application is the National Stage Entry of International Application No. PCT/US2023/029801, filed on Aug. 9, 2023, which claims priority to and the benefit of U.S. Provisional Patent Application Ser. No. 63/370,876, entitled "Methods for Real-Time Optimization of Coiled Tubing Cleanout Operations Using Downhole Pressure Sensors," filed Aug. 9, 2022, which is hereby incorporated by reference in its entirety for all purposes.

BACKGROUND

The present disclosure generally relates to systems and methods for optimizing coiled tubing cleanout operations using downhole pressure sensors. The present disclosure is related in general to wellsite equipment such as oilfield surface equipment including, but not limited to, pressure pumping equipment, mixing equipment and the like, downhole tools and assemblies, coiled tubing (CT) tools and assemblies, slickline tools and assemblies, wireline tools and assemblies, and the like.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Coiled tubing is a technology that has been expanding its range of applications since its introduction to the oil industry in the 1960s. Its ability to pass through completion tubulars, as well as the wide array of tools and technologies that can be used in conjunction with it, make it a very versatile technology.

A typical coiled tubing apparatus includes surface pumping facilities, a coiled tubing string mounted on a reel, a method to convey the coiled tubing into and out of the wellbore, such as an injector head or the like, and surface control apparatus at the wellhead. Coiled tubing has been utilized for performing well treatment and/or well intervention operations in existing wellbores such as, but not limited to, hydraulic fracturing operations, matrix acidizing operations, milling operations, perforating operations, cleanout operations, coiled tubing drilling operations, nitrogen kick-off operations, fishing operations, zonal isolation operations, and so forth.

Coiled tubing cleanout operations are utilized to transport particles and fill from a wellbore to the wellbore surface. Sources of the particles and fill may include formation sand from the reservoir, proppant used for hydraulic fracturing, debris from workovers, and organic scale, among other sources.

Coiled tubing cleanout operations can be relatively complex operations that, in order to successfully accomplish transporting particles and fill to the wellbore surface, need to account for various factors for success that include, but are not limited to, wellbore hydraulics, movement of the coiled tubing, reservoir flow and coupling between the wellbore and the reservoir, nitrified fluids injection, solid transport, phase changes, and temperature evolution and distribution along the wellbore.

It remains desirable to provide improvements in oilfield surface equipment and/or downhole assemblies and methods of using such equipment or assemblies such as, but not limited to, methods for optimizing coiled tubing operations including, but not limited to, cleanout operations.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a method that includes acquiring, via one or more downhole sensors of a coiled tubing system at least partially disposed within a wellbore, downhole data of the coiled tubing system. The method also includes identifying, via a processing and control system, a density profile of fluids disposed within the wellbore based at least in part on the acquired downhole data. The method further includes interpreting, via the processing and control system, the density profile of the fluids disposed within the wellbore. In addition, the method includes estimating, via the processing and control system, a reservoir pressure of a reservoir through which the wellbore extends based at least in part on the interpreted density profile of the fluids disposed within the wellbore.

Certain embodiments of the present disclosure also include a processing and control system having one or more processors configured to execute processor-executable instructions stored in memory media of the processing and control system. The processor-executable instructions, when executed by the one or more processors, cause the processing and control system to: identify a density profile of fluids disposed within a wellbore based at least in part on downhole data acquired via one or more downhole sensors of a coiled tubing system at least partially disposed within the wellbore; interpret the density profile of the fluids disposed within the wellbore; and estimate a reservoir pressure of a reservoir through which the wellbore extends based at least in part on the interpreted density profile of the fluids disposed within the wellbore.

Certain embodiments of the present disclosure also include a method that includes acquiring, via one or more downhole sensors of a coiled tubing system at least partially disposed within a wellbore, downhole data of the coiled tubing system prior to a coiled tubing cleanout operation performed by the coiled tubing system while the wellbore is shut-in. The method also includes identifying, via a processing and control system, a density profile of fluids disposed within the wellbore based at least in part on the acquired downhole data. The method further includes interpreting, via the processing and control system, the density profile of the fluids disposed within the wellbore. In addition, the method includes estimating, via the processing and control system, a reservoir pressure of a reservoir through which the wellbore extends based at least in part on the interpreted density profile of the fluids disposed within the wellbore.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
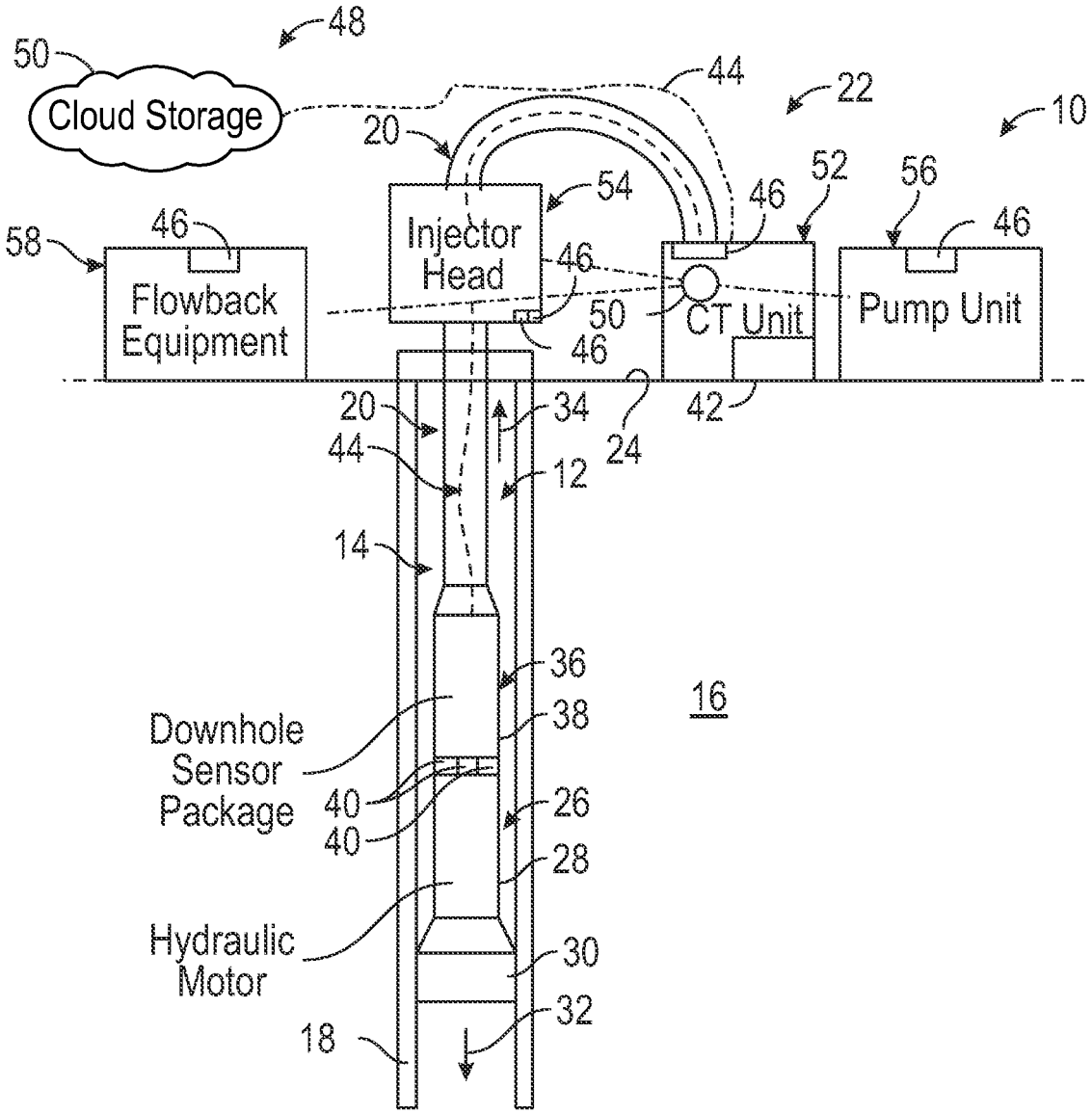
FIG. 1 illustrates a schematic diagram of an example coiled tubing system, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed or are caused to be performed, for example, by a processing system (i.e., solely by the processing system, without human intervention). In addition, as used herein, the term "approximately equal to" may be used to mean values that are relatively close to each other (e.g., within 5%, within 2%, within 1%, within 0.5%, or even closer, of each other).

During the life of an oil or gas production well, solid particles such as sand produced from unconsolidated formations or proppant left in the wellbore after an earlier fracturing job may settle at various depths along the wellbore. In some cases, they may accumulate into solid fills or form deep solid beds over significant distances in the wellbore. Cleanout Operations with Coiled Tubing (CTCO) consist in flushing these solid particles to surface by injecting fluids through the end of coiled tubing, next to where the solids lay in the wellbore. By supplying enough flow, the particles may remain suspended in the injected fluids and transported to surface.

To design a cleanout job, engineers often use computer programs that can simulate all the relevant physical phenomena occurring during such operations. Using such simulators, engineers investigate options such as pump rates, fluids to be pumped, coiled tubing movements that may provide the optimum CTCO, and so forth. In many situations, some input parameters required by the simulators are not known with sufficient accuracy for the simulator's predictions to be reliable. For instance, the initial position and size of the solid fills in the wellbore is typically not known accurately prior to running the coiled tubing into hole. In this case, defining a CTCO design may be very challenging.

Acquisition data sets obtained during CTCOs in sub-hydrostatic wells have shown that it may be possible to determine the initial wellbore fluid distribution prior to the start of pumping, in particular, the depth of the gas-oil interface and the depth of the oil-water interface. One objective of using the real-time automation methodology described herein is to obtain an early estimate of the reservoir pressure using inferred initial fluid distribution before the wellbore fluid system becomes perturbated by flow associated with the cleanout operation (e.g., while the wellbore is shut-in). With an estimate of the average reservoir pressure, an earlier assessment as to whether the CTCO is being performed in under- or over-balanced conditions such that, for example, operational adjustments may be implemented. The embodiments described herein may also be used to check that the maximum tolerable drawdown is not exceeded as to minimize the risk of solid influx from the reservoir into the wellbore. Typically, coiled tubing cleanouts involve multiple runs, each separated by a period during which the coiled tubing (CT) is back to surface and does not operate. The methodology described here applies to the first run, as subsequent runs may have less stable initial conditions and since the reservoir pressure estimated from the first run should also apply to the subsequent ones.

With the foregoing in mind, FIG. 1 illustrates a schematic diagram of an example coiled tubing system 10. As illustrated, in certain embodiments, a coiled tubing string 12 may be run into a wellbore 14 that traverses a hydrocarbon-bearing formation 16 (i.e., reservoir). While certain elements of the coiled tubing system 10 are illustrated in FIG. 1, other elements of the coiled tubing system 10 (e.g., blow-out preventers, wellhead "tree", etc.) may be omitted for clarity of illustration. In certain embodiments, the coiled tubing system 10 includes an interconnection of pipes, including vertical and/or horizontal casings 18, coiled tubing 20, and so forth, that connect to a surface facility 22 at the surface 24 of the coiled tubing system 10. In certain embodiments, the coiled tubing 20 extends inside the casing 18 and terminates at a tubing head (not shown) at or near the surface 24. In addition, in certain embodiments, the casing 18 contacts the wellbore 14 and terminates at a casing head (not shown) at or near the surface 24.

In certain embodiments, a bottom hole assembly ("BHA") 26 may be run inside the casing 18 by the coiled tubing 20. As illustrated in FIG. 1, in certain embodiments, the BHA 26 may include a downhole motor 28 that operates to rotate a drill bit 30 (e.g., during drilling operations) or other downhole tools. In certain embodiments, the downhole motor 28 may be driven by hydraulic forces carried in fluid supplied from the surface 24 of the coiled tubing system 10. In certain embodiments, the BHA 26 may be connected to the coiled tubing 20, which is used to run the BHA 26 to a desired location within the wellbore 14. It is also contemplated that, in certain embodiments, the rotary motion of the drill bit 30 may be driven by rotation of the coiled tubing 20 effectuated by a rotary table or other surface-located rotary actuator. In such embodiments, the downhole motor 28 may be omitted.

In certain embodiments, the coiled tubing 20 may also be used to deliver fluid 32 to the drill bit 30 through an interior of the coiled tubing 20 to aid in the drilling process and carry cuttings and possibly other fluid or solid components in return fluid 34 that flows up the annulus between the coiled tubing 20 and the casing 18 (or via a return flow path provided by the coiled tubing 20, in certain embodiments) for return to the surface facility 22. It is also contemplated that the return fluid 34 may include remnant proppant (e.g., sand) or possibly rock fragments that result from a hydraulic fracturing application, and flow within the coiled tubing system 10. Under certain conditions, fracturing fluid and possibly hydrocarbons (oil and/or gas), proppants and possibly rock fragments may flow from the fractured formation 16 through perforations in a newly opened interval and back to the surface 24 of the coiled tubing system 10 as part of the return fluid 34. In certain embodiments, the BHA 26 may be supplemented behind a rotary drill by an isolation device such as, for example, an inflatable packer that may be activated to isolate the zone below or above it and enable local pressure tests.

As such, in certain embodiments, the coiled tubing system 10 may include a downhole well tool 36 that is moved along the wellbore 14 via the coiled tubing 20. In certain embodiments, the downhole well tool 36 may include a variety of drilling/cutting tools coupled with the coiled tubing 20 to provide a coiled tubing string 12. In the illustrated embodiment, the downhole well tool 36 includes the drill bit 30, which may be powered by the downhole motor 28 (e.g., a positive displacement motor (PDM), or other hydraulic motor) of the BHA 26. In certain embodiments, the wellbore 14 may be an open wellbore or a cased wellbore defined by the casing 18. In addition, in certain embodiments, the wellbore 14 may be vertical or horizontal or inclined. It should be noted that the downhole well tool 36 may be part of various types of BHAs 26 coupled to the coiled tubing 20.

As also illustrated in FIG. 1, in certain embodiments, the coiled tubing system 10 may include a downhole sensor package 38 having multiple downhole sensors 40. In certain embodiments, the sensor package 38 may be mounted along the coiled tubing string 12, although certain downhole sensors 40 may be positioned at other downhole locations in other embodiments. In addition, in certain embodiments, downhole sensors 40 disposed on the coiled tubing 20 may be configured to detect downhole flow rates, downhole temperatures, and downhole pressures, and so forth, in the wellbore 14. In addition, in certain embodiments, downhole sensors 40 disposed on the casing 18 may be configured to detect downhole temperatures, and downhole pressures, and so forth, in the wellbore 14.

In certain embodiments, data from the downhole sensors 40 may be relayed uphole to a surface processing system 42 (e.g., a computer-based processing system) disposed at the surface 24 and/or other suitable location of the coiled tubing system 10. In certain embodiments, the data may be relayed uphole in substantially real time (e.g., relayed while it is detected by the downhole sensors 40 during operation of the downhole well tool 36) via a wired or wireless telemetric control line 44, and this real-time data may be referred to as edge data. In certain embodiments, the telemetric control line 44 may be in the form of an electrical line, fiber-optic line, or other suitable control line for transmitting data signals. In certain embodiments, the telemetric control line 44 may be routed along an interior of the coiled tubing 20, within a wall of the coiled tubing 20, or along an exterior of the coiled tubing 20. In addition, as described in greater detail herein, additional data (e.g., surface data) may be supplied by surface sensors 46 and/or stored in a memory location 48. By way of example, historical data and other useful data may be stored in the memory location 48 such as a cloud storage 50.

As illustrated, in certain embodiments, the coiled tubing 20 may be deployed by a coiled tubing unit 52 and delivered downhole via an injector head 54. In certain embodiments, the injector head 54 may be controlled to slack off or pick up the coiled tubing 20 so as to control the tubing string weight and, thus, the weight on bit (WOB) acting on the drill bit 30 (or the downhole well tool 36). In certain embodiments, the downhole well tool 36 may be moved along the wellbore 14 via the coiled tubing 20 under control of the injector head 54 so as to apply a desired tubing weight and, thus, to achieve a desired rate of penetration (ROP) as the drill bit 30 is operated. Depending on the specifics of a given application, various types of data may be collected downhole, and transmitted to the surface processing system 42 in substantially real time to facilitate improved operation of the downhole well tool 36. For example, the data may be used to fully or partially automate downhole operations, to optimize the downhole operations, and/or to provide more accurate predictions regarding components or aspects of the downhole operations.

In certain embodiments, fluid 32 may be delivered downhole under pressure from a pump unit 56. In certain embodiments, the fluid 32 may be delivered by the pump unit 56 through the downhole hydraulic motor 28 to power the downhole hydraulic motor 28 and, thus, the drill bit 30. In certain embodiments, the return fluid 34 is returned uphole, and this flow back of the return fluid 34 is controlled by suitable flowback equipment 58. In certain embodiments, the flowback equipment 58 may include chokes and other components/equipment used to control flow back of the return fluid 34 in a variety of applications, including well treatment applications.

As described in greater detail herein, the coiled tubing unit 52, the injector head 54, the pump unit 56, and the flowback equipment 58 may include advanced surface sensors 46, actuators, and local controllers, such as PLCs, which may cooperate together to provide sensor data to, receive control signals from, and generate local control signals based on communications with, respectively, the surface processing system 42. In certain embodiments, as described in greater detail herein, the surface sensors 46 may include flow rate, pressure, and fluid rheology sensors 46, among other types of sensors. In addition, as described in greater detail herein, the actuators may include actuators for pump and choke control of the pump unit 56 and the flowback equipment 58, respectively, among other types of actuators.

In certain embodiments, surface sensors 46 of the coiled tubing unit 52 may be configured to detect positions of the coiled tubing 20, weights of the coiled tubing 20, and so forth. In addition, in certain embodiments, surface sensors 46 of the injector head 54 may be configured to detect wellhead pressure, and so forth. In addition, in certain embodiments, surface sensors 46 of the pump unit 56 may be configured to detect pump pressures, pump flow rates, and so forth. In addition, in certain embodiments, surface sensors 46 of the flowback equipment 58 may be configured to detect fluids production rates, solids production rates, and so forth.

Figure 2:
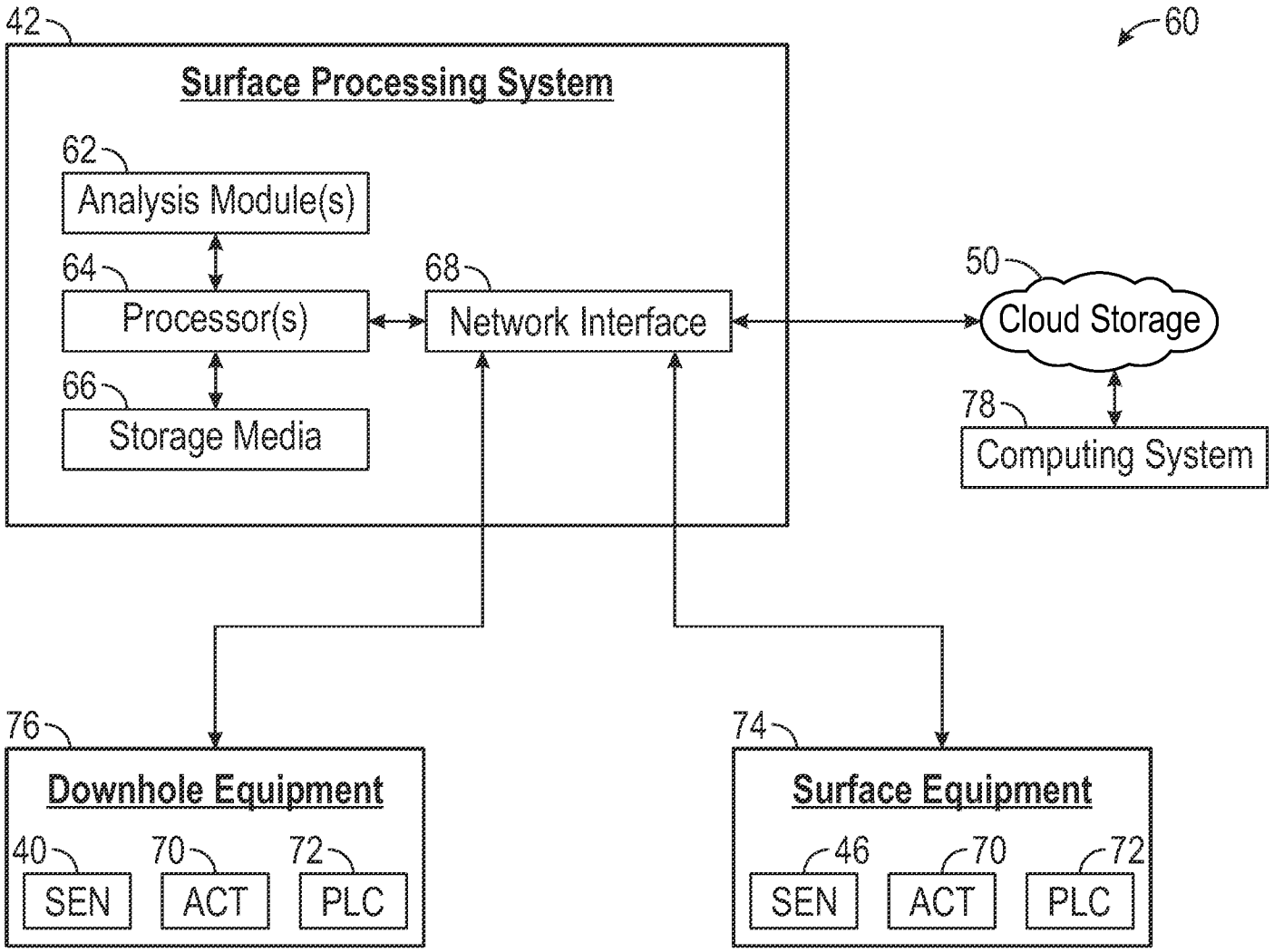
FIG. 2 illustrates a well control system including a surface processing system to control the coiled tubing system of FIG. 1, in accordance with embodiments of the present disclosure.

FIG. 2 illustrates a well control system 60 that may include the surface processing system 42 to control the coiled tubing system 10 described herein. In certain embodiments, the surface processing system 42 may include one or more analysis modules 62 (e.g., a program of computer-executable instructions and associated data) that may be configured to perform various functions of the embodiments described herein. In certain embodiments, to perform these various functions, the one or more analysis modules 62 may execute on one or more processors 64 of the surface processing system 42, which may be connected to one or more storage media 66 of the surface processing system 42. Indeed, in certain embodiments, the one or more analysis modules 62 may be stored in the one or more storage media 66.

In certain embodiments, the computer-executable instructions of the one or more analysis modules 62, when executed by the one or more processors 64, may cause the one or more processors 64 to generate one or more models. Such models may be used by the surface processing system 42 to predict values of operational parameters that may or may not be measured (e.g., using gauges, sensors) during well operations.

In certain embodiments, the one or more processors 64 may include a microprocessor, a microcontroller, a processor module or subsystem, a programmable integrated circuit, a programmable gate array, a digital signal processor (DSP), or another control or computing device. In certain embodiments, the one or more processors 64 may include machine learning and/or artificial intelligence (AI) based processors. In certain embodiments, the one or more storage media 66 may be implemented as one or more non-transitory computer-readable or machine-readable storage media. In certain embodiments, the one or more storage media 66 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 62 may be provided on one computer-readable or machine-readable storage medium of the storage media 66, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 66 may be located either in the machine running the machine-readable instructions, or may be located at a remote site from which machine-readable instructions may be downloaded over a network for execution.

In certain embodiments, the processor(s) 64 may be connected to a network interface 68 of the surface processing system 42 to allow the surface processing system 42 to communicate with the multiple downhole sensors 40 and surface sensors 46 described herein, as well as communicate with the actuators 70 and/or PLCs 72 of the surface equipment 74 (e.g., the coiled tubing unit 52, the pump unit 56, the flowback equipment 58, and so forth) and of the downhole equipment 76 (e.g., the BHA 26, the downhole motor 28, the drill bit 30, the downhole well tool 36, and so forth) for the purpose of controlling operation of the coiled tubing system 10, as described in greater detail herein. In certain embodiments, the network interface 68 may also facilitate the surface processing system 42 to communicate data to the cloud storage 50 (or other wired and/or wireless communication network) to, for example, archive the data or to enable external computing systems 78 to access the data and/or to remotely interact with the surface processing system 42.

It should be appreciated that the well control system 60 illustrated in FIG. 2 is only one example of a well control system, and that the well control system 60 may have more or fewer components than shown, may combine additional components not depicted in the embodiment of FIG. 2, and/or the well control system 60 may have a different configuration or arrangement of the components depicted in FIG. 2. In addition, the various components illustrated in FIG. 2 may be implemented in hardware, software, or a combination of both hardware and software, including one or more signal processing and/or application specific integrated circuits. Furthermore, the operations of the well control system 60 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

As described in greater detail herein, the embodiments described herein facilitate the operation of well-related tools. For example, a variety of data (e.g., downhole data and surface data) may be collected to enable optimization of operations of well-related tools such as the downhole well tool 36 illustrated in FIG. 1 by the surface processing system 42 illustrated in FIG. 2 (or other suitable processing systems). In certain embodiments, the data may be provided as advisory data by the surface processing system 42 (or other suitable processing systems). However, in other embodiments, the data may be used to facilitate automation of downhole processes and/or surface processes (i.e., the processes may be automated without human intervention), as described in greater detail herein, by the surface processing system 42 (or other suitable processing system). The embodiments described herein may enhance downhole operations by improving the efficiency and utilization of data to enable performance optimization and improved resource controls.

As described in greater detail herein, in certain embodiments, downhole parameters may be obtained via, for example, downhole sensors 40 while the downhole well tool 36 is disposed within the wellbore 14. In certain embodiments, the downhole parameters may be obtained in substantially real time and sent to the surface processing system 42 via wired or wireless telemetry. In certain embodiments, downhole parameters may be combined with surface parameters by the surface processing system 42. In certain embodiments, the downhole and surface parameters may be processed by the surface processing system 42 during use of the downhole well tool 36 to enable automatic (e.g., without human intervention) optimization with respect to use of the downhole well tool 36 during subsequent stages of operation of the downhole well tool 36.

Non-limiting examples of downhole parameters that may be sensed in substantially real time include, but are not limited to, weight on bit (WOB), torque acting on the downhole well tool 36, downhole pressures, downhole differential pressures, and other desired downhole parameters. In certain embodiments, downhole parameters may be used by the surface processing system 42 in combination with surface parameters, and such surface parameters may include, but are not limited to, pump-related parameters (e.g., pump rate and circulating pressures of the pump unit 56). In certain embodiments, the surface parameters also may include parameters related to fluid returns (e.g., wellhead pressure, return fluid flow rate, choke settings, amount of proppant returned, and other desired surface parameters). In certain embodiments, the surface parameters also may include data from the coiled tubing unit 52 (e.g., surface weight of the coiled tubing string 12, speed of the coiled tubing 20, rate of penetration, and other desired parameters). In certain embodiments, the surface data that may be processed by the surface processing system 42 to optimize performance also may include previously recorded data such as fracturing data (e.g., close-in pressures from each fracturing stage, proppant data, friction data, fluid volume data, and other desired data).

In certain embodiments, use of the downhole data and surface data enables the surface processing system 42 to self-learn (e.g., modeling or simulation using the machine learning or artificial intelligence (AI) based processors, machine learning or AI based algorithms stored in the one or more storage media 66, or combinations thereof). This real-time modeling by the surface processing system 42, based on the downhole and surface parameters, enables improved downhole operations. Such modeling by the surface processing system 42 also enables the downhole process to be automated and automatically optimized by the surface processing system 42. For instance, the modeling based on the downhole parameters may be used by the surface processing system 42 to predict wear on the downhole motor 28 and/or the drill bit 30, and to advise as to timing of the next trip to the surface for replacement of the downhole motor 28 and/or the drill bit 30.

In certain embodiments, the modeling based on the downhole parameters also enable use of pressures to be used by the surface processing system 42 in characterizing the formation 16. Such real-time downhole parameters also enable use of pressures by the surface processing system 42 for in situ evaluation and advisory of post-fracturing flow back parameters, and for creating an optimum flow back schedule for maximized production of, for example, hydrocarbon fluids from the surrounding formation 16. Data available from a given well may be utilized in designing the next fracturing schedule for the same pad/neighbor wells as well as predictions regarding subsequent wells.

For example, downhole data such as WOB, torque data from a load module associated with the downhole well tool 36, and bottom hole pressures (internal and external to the bottom hole assembly 26/downhole well tool 36) may be processed via the surface processing system 42. The processed data may then be utilized by the surface processing system 42 to control the injector head 54 to generate, for example, a faster and more controlled rate of penetration (ROP). Additionally, the processed data may be updated by the surface processing system 42 as the downhole well tool 36 is moved to different positions along the wellbore 14 to help optimize operations. The processed data also enables automation of the downhole process through automated controls over the injector head 54 via control instructions provided by the surface processing system 42.

In certain embodiments, data from downhole may be combined by the surface processing system 42 with surface data received from injector head 54 and/or other measured or stored surface data. By way of example, surface data may include hanging weight of the coiled tubing string 12, speed of the coiled tubing 20, wellhead pressure, choke and flow back pressures, return pump rates, circulating pressures (e.g., circulating pressures from the manifold of a coiled tubing reel in the coiled tubing unit 52), and pump rates. The surface data may be combined with the downhole data by the surface processing system 42 in real time to provide an automated system that self-controls the injector head 54. For example, the injector head 54 may be automatically controlled (e.g., without human intervention) to optimize ROP under direction from the surface processing system 42.

In certain embodiments, data from drilling parameters (e.g., surveys and pressures) as well as fracturing parameters (e.g., volumes and pressures) may be combined with real-time data obtained from sensors 40, 46. The combined data may be used by the surface processing system 42 in a manner that aids in machine learning and/or artificial intelligence to automate subsequent jobs in the same well and/or for neighboring wells. The accurate combination of data and the updating of that data in real time helps the surface processing system 42 improve the automatic performance of subsequent tasks.

In certain embodiments, depending on the type of operation downhole, the surface processing system 42 may be programmed with a variety of algorithms and/or modeling techniques to achieve desired results. For example, the downhole data and surface data may be combined and at least some of the data may be updated in real time by the surface processing system 42. This updated data may be processed by the surface processing system 42 via suitable algorithms to enable automation and to improve the performance of, for example, downhole well tool 36. By way of example, the data may be processed and used by the surface processing system 42 for preventing motor stalls. In certain embodiments, downhole parameters such as forces, torque, and pressure differentials may be combined by the surface processing system 42 to enable prediction of a next stall of the downhole motor 28 and/or to give a warning to a supervisor. In such embodiments, the surface processing system 42 may be programmed to make self-adjustments (e.g., automatically, without human intervention) to, for example, speed of the injector head 54 and/or pump pressures to prevent the stall, and to ensure efficient continuous operation.

In addition, in certain embodiments, the data and the ongoing collection of data may be used by the surface processing system 42 to monitor various aspects of the performance of downhole motor 28. For example, motor wear may be detected by monitoring the effective torque of the downhole motor 28 based on data obtained regarding pump rates, pressure differentials, and actual torque measurements of the downhole well tool 36. Various algorithms may be used by the surface processing system 42 to help a supervisor on site to predict, for example, how many more hours the downhole motor 28 may be run efficiently. This data, and the appropriate processing of the data, may be used by the surface processing system 42 to make automatic decisions or to provide indications to a supervisor as to when to pull the coiled tubing string 12 to the surface to replace the downhole motor 28, the drill bit 30, or both, while avoiding unnecessary trips to the surface.

In certain embodiments, downhole data and surface data also may be processed via the surface processing system 42 to predict a time when the coiled tubing string 12 may become stuck. The ability to predict when the coiled tubing string 12 may become stuck helps avoid unnecessary short trips and, thus, improves coiled tubing pipe longevity. In certain embodiments, downhole parameters such as forces, torque, and pressure differentials in combination with surface parameters such as weight of the coiled tubing 20, speed of the coiled tubing 20, pump rate, and circulating pressure may be processed via the surface processing system 42 to provide predictions as to the time when the coiled tubing 20 will become stuck.

In certain embodiments, the surface processing system 42 may be designed to provide warnings to a supervisor and/or to self-adjust (e.g., automatically, without human intervention) either the speed of the injector head 54, the pump pressures and rates of the pump unit 56, or a combination of both, so as to prevent the coiled tubing 20 from getting stuck based on the predictions described herein. By way of example, the warnings or other information may be output to a display of the surface processing system 42 to enable an operator to make better, more informed decisions regarding downhole or surface processes related to operation of the downhole well tool 36. In certain embodiments, the speed of the injector head 54 may be controlled via the surface processing system 42 by controlling the slack-off force from the surface. In general, the ability to predict and prevent the coiled tubing 20 from becoming stuck substantially improves the overall efficiency and helps avoid unnecessary short trips if the probability of the coiled tubing 20 getting stuck is minimal. Accordingly, the downhole data and surface data may be used by the surface processing system 42 to provide advisory information and/or automation of surface processes, such as pumping processes or other processes.

As described above, acquisition data sets obtained during CTCOs in sub-hydrostatic wells have shown that it may be possible to determine the initial wellbore fluid distribution prior to the start of pumping, in particular, the depth of the gas-oil interface and the depth of the oil-water interface. One objective of using the real-time automation methodology described herein is to obtain an early estimate of the reservoir pressure using inferred initial fluid distribution before the wellbore fluid system becomes perturbated by flow associated with the cleanout operation (e.g., while the wellbore 14 is shut-in). With an estimate of the average reservoir pressure, an earlier assessment as to whether the CTCO is being performed in under- or over-balanced conditions such that, for example, operational adjustments may be implemented. The embodiments described herein may also be used to check that the maximum tolerable drawdown is not exceeded as to minimize the risk of solid influx from the reservoir into the wellbore. Typically, coiled tubing cleanouts involve multiple runs, each separated by a period during which the coiled tubing 20 is back to the surface 24 and does not operate.

Figure 3:
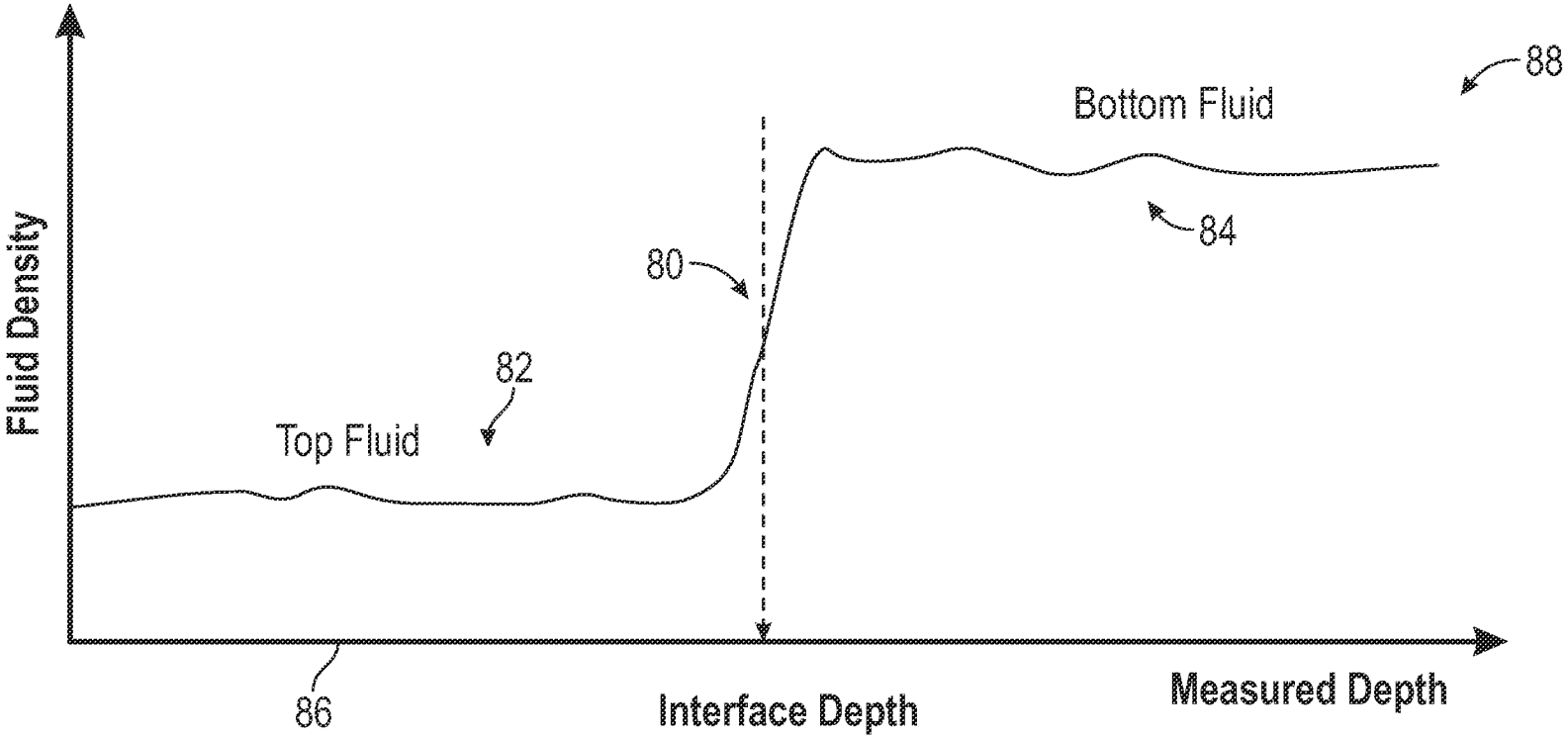
FIG. 3 is a fluid density profile calculated during data acquisition, showing a fluid-fluid interface, in accordance with embodiments of the present disclosure.

The methodology described herein may apply to a first CTCO run, as subsequent runs may have less stable initial conditions and since the reservoir pressure estimated from the first run should also apply to the subsequent ones. The methodology is based on experience that, before the coiled tubing cleanout starts and while the well is shut-in, interfaces 80 between two fluids 82, 84 of different densities (e.g., a top fluid 82 and a bottom fluid 84) may be present at certain depths 86 along the wellbore 14, as illustrated in the fluid density profile 88 illustrated in FIG. 3. In many cases encountered with CTCOs, the top fluid 82 may be a gas, and the bottom fluid 84 may be either water or oil, or both. The embodiments described herein consider cases where only two fluids are initially present in the wellbore 14 as the three-fluid situation has never been met so far and for simplification. Extending the method to the three-fluid situation is relatively easy. The automation of the present disclosure aims to approximate the shape of this curve by assuming that the fluid above (below) the interface 80, located at $i_x$ has a constant density $\rho_{x,1}$ ($\rho_{x,2}$) where x denotes the method used for the approximation.

Figure 4:
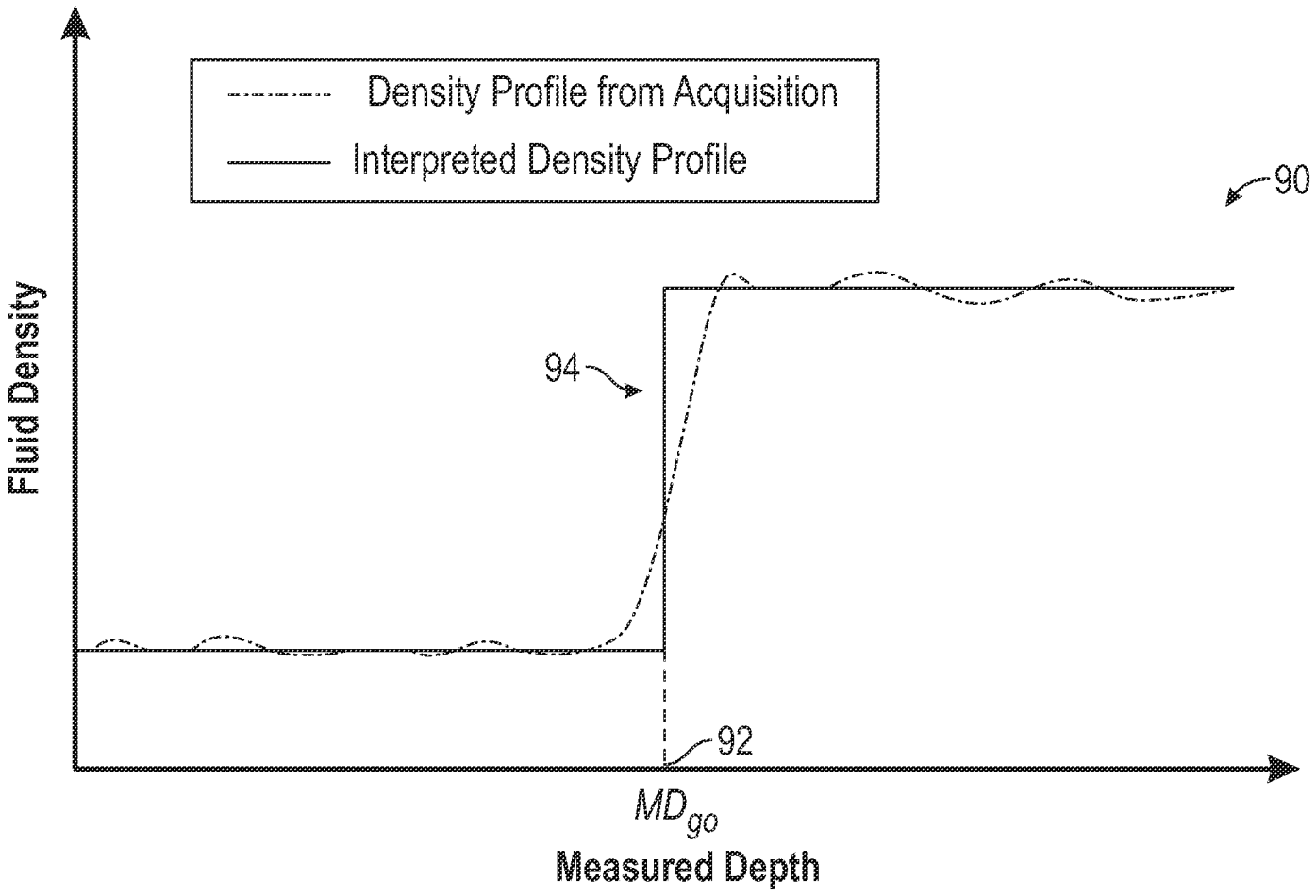
FIG. 4 are density profiles around a fluid-fluid interface as measured from acquisition and interpreted, in accordance with embodiments of the present disclosure.

The resulting interpretation is illustrated in FIG. 4, where the density profile 90 of $\overline{\rho}_{bha}$ obtained from acquisition may be approximated by a step function as illustrated in FIG. 4. This approximation is performed using a minimization algorithm that provides the depth 92 at which the step 94 occurs. The depth 92 of this step 94 is taken as the depth of the gas-oil interface ($MD_{go}$). It should be noted that this interface presence does not necessarily mean that oil is the fluid below it. For example, it may be water, in which case, as explained below, it may be determined that $MD_{go}=MD_{ow}$.

Figure 5:
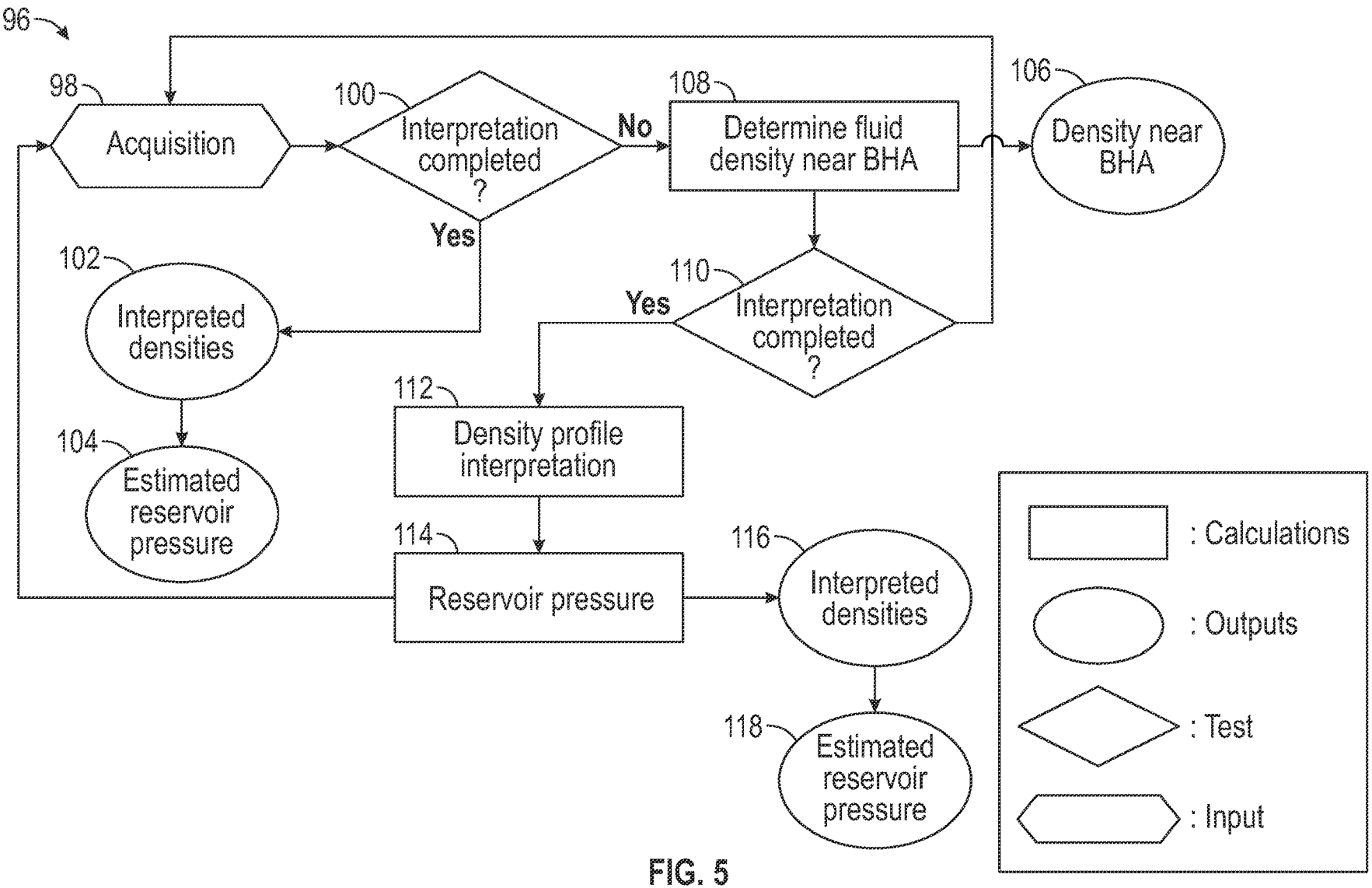
FIG. 5 is a flow diagram of a workflow for estimating reservoir pressure, in accordance with embodiments of the present disclosure.

Once $\rho_{x,1}$ and $\rho_{x,2}$ and $i_x$ are known, the reservoir pressure $p_{x,res}$ is advantageously estimated by hydrostatic correction from the depth of a downhole pressure gauge (DHPG) and its associated pressure reading $p_{dhpg}$. The flow diagram of a workflow 96 followed by the automation (e.g., as performed by the surface processing system 42) is illustrated in FIG. 5. While the coiled tubing 20 first runs into hole (RIH), the automation is provided (e.g., by the surface processing system 42) using the following measurements in real time:

- $MD_{bha}$: measured depth of the coiled tubing 20 (depth of the BHA 26);
- $\rho_{bha}$: density of the fluid in the annulus around the BHA 26;
- $p_{dhpg}$: downhole pressure at the DHPG; and
- $p_{wh}$: pressure in the wellbore 14.

With these measurements, the workflow 96, as shown in FIG. 5, calculates and outputs in real-time the density of the fluid around the BHA 26, $\rho_{bha}$, and updates the calculated density profile from the wellhead to the BHA 26. Once it is determined that the BHA 26 is sufficiently far beyond the interface depth $i_x$, the density updates are stopped, and the calculated density profile may be interpreted as a step function, as illustrated in FIG. 4, using a minimization algorithm. At that point, $i_x$, $\rho_{x,1}$ $\rho_{x,2}$ have been determined and the automation of the present disclosure uses them to estimate $p_{x,res}$, the average reservoir pressure. From that point on, the automation outputs $i_x$, $\rho_{x,1}$ $\rho_{x,2}$ and $p_{x,res}$ and these do not evolve in time.

As illustrated in FIG. 5, the workflow 96 begins with acquisition 98 of the data described herein (e.g., as collected by the downhole sensors 40, for example, downhole pressure sensors). Then, a determination 100 may be made whether the interpretation has been completed. If the interpretation has been completed, the interpreted densities 102 may be used to estimate the reservoir pressure 104. Conversely, if the interpretation has not been completed, the fluid density 106 of the fluid near the BHA 26 may be determined 108. Then, another determination 110 may be made whether the interpretation has been completed, after which a density profile interpretation 112 may be used to determine the reservoir pressure 114. Then, the interpreted densities 116 may be used to estimate the reservoir pressure 118.

Three methods are described below in the present disclosure. The first and second methods are more reliable in that the third assumes that $p_{bha}$ is not available.

Physical Concepts

Density calculations and pressure extrapolations are based on the basic laws of fluid statics. The average fluid density p between two True Vertical Depths (TVD) points $TVD_1$ and $TVD_2$ may be estimated using the known pressures $p_1$ and $p_2$ at those points.

$$\rho = \frac{p_2 - p_1}{9.81 \times (TVD_2 - TVD_1)} \tag{1}$$

Equation (1) may also be used to extrapolate pressures at various depths when pressure is known at a given depth and when the average fluid density is known between the two depths. In addition, Equation (1) may also be used to determine the average fluid density around the BHA 26, $\rho_{bha}$, using $p_{bha}$ at two different TVDs of the BHA 26.

Reservoir Pressure

In the present disclosure, reservoir pressure $p_{res}$ is referred to as the average of the far-field formation pressures in each of the zones connected to the wellbore 14. Average is defined as the total vertical depth (TVD)-based wellbore pressure average along the production interval that generates zero net flow. The net flow is the sum of inflow and leak-off rates between the reservoir 16 and the wellbore 14. When such a wellbore pressure is reached, the fluid distribution along the reservoir 16 is steady even if some through-wellbore cross-flow may occur between the various zones of the reservoir 16.

Being above (below) $p_{res}$ in the wellbore 14 does guarantee no leak-off (inflow) occurs locally in a given zone. This depends on the distribution of the zone pressures, but without access to this distribution, this remains the only possible indicator to control overall net leak-off and inflow.

Acquisition and Data Quality Control

The real-time 1-Hz frequency estimate of fluid densities using the BHA annular pressure measurement, and/or other pressure gauge data, may lead to relatively noisy results. Some filtering and smoothing may be required for practical purposes. The following quality control rules and/or guidelines have been found to be efficient at reducing the amount of noise in the context of past coiled tubing cleanout operations.

- Use data only before fluid is pumped for the first time
- Use data only when coiled tubing 20 is running into hole (downwards motion)
- Use data when the coiled tubing downwards speed is above 0.1 m/s
- For density estimates between two successive positions of the BHA 26, consider TVD different between 10 meters and 30 meters
- Discard any result returning density below gas density and 10% above sea water
- Perform running averaging over the last 20 seconds Maximum Interface Depth and Stop Criterion Only three different fluids may be found in the wellbore 14: gas, oil and water. If an interface is initially present in the wellbore 14, its deepest possible position would be given by comparing where it would have to be if the two fluids were:

- gas and water, or
- gas and oil, or
- oil and water,
- and assuming that the fluid with largest density $\rho_2$ lays below the interface. Given estimated densities of these three fluids and using the values of $p_{dhpg}$ and $p_{wh}$, three values of i, the measured depth of the interface, could be determined before the operation starts, and the largest $i_{max}$ is used as reference.

$$TVD(i_{max}) = \frac{9.81\rho_2 TVD_{dhpg} - (p_{dhpg} - p_{wh})}{9.81(\rho_2 - \rho_1)} \tag{2}$$

The automation stops when a user-defined TVD distance below TVD ($i_{max}$) is reached by the BHA 26 or as soon as a user-defined maximum interpretation time is reached, whichever comes first. The three methods mentioned above will now be detailed.

Method 1:

The reservoir pressure $p_{1,res}$ (Method 1) returned by the automation, once the maximum coiled tubing depth or run in hole (RIH) time is reached, is calculated as follows.

$$p_{1,res} = p_{dhpg} - 9.81 \times (TVD_{dhpg} - TVD_{res})\rho_{1,2} \quad (3)$$

During execution, the density of the fluid around the BHA 26, $\rho_1$ returned by the automation as out_density_1 at all time steps, is calculated using the following parameters.

$$\rho_{1,2} = \rho_{1,2}(\rho_{bha}, \rho_{bha/wh}, \rho_{bha/dhpg}, TVD_{bha}) \quad (4)$$

- $\rho_{bha}$: density measured by changes of $TVD_{bha}$ during initial run in hole (RIH)
- $\rho_{bha/wh}$: density measured by changes of $TVD_{bha}$ during initial RIH, corrected by $p_{wh}$ variations during that measurement. The correction is obtained by using $\rho_{bha}-p_{wh}$ instead of $p_{bha}$ for p and $TVD_{bha}$ for TVD in Equation (1).
- $\rho_{bha/dhpg}$: density measured by changes of $TVD_{bha}$ during initial RIH, corrected by $p_{dhpg}$ variations during that measurement. The correction is obtained by using $p_{bha}-p_{dhpg}$ instead of $p_{bha}$ for p and $TVD_{bha}$ for TVD in Equation (1).

The weight applied to each density in Equation (4) is a function of $TVD_{bha}$. Once the maximum coiled tubing depth or RIH time is reached, $i_1$ (out_gc_1) may be determined together with $\rho_{1,1}$ and $\rho_{1,2}$ by best fit of the step-wise function represented in FIG. 4. From that point on, the automation output out_density_1 is $\rho_{1,2}$ and $p_{1,res}$ may be determined using Equation (3).

Method 2:

The reservoir pressure $p_{2,res}$ (Method 2) returned by the automation, once the maximum coiled tubing depth or RIH time is reached, is calculated as follows.

$$p_{2,res} = p_{dhpg} - 9.81 \times (TVD_{dhpg} - TVD_{res})\rho_{2,2} \quad (5)$$

During execution, the density in the neighborhood of the BHA 26, $\rho_{2,2}$, returned by the automation as, $\rho_2$ or "out_density_2" at all time steps is calculated using the following parameters.

$$\rho_2 = \begin{cases} \rho_{bha/wh} \\ \rho_{bha-dhpg} \end{cases}$$

if the value is less than an initially estimated oil density otherwise

- $\rho_{bha/wh}$: density measured by changes of $TVD_{bha}$ during initial RIH, corrected by $p_{wh}$ during that measurement. The correction is obtained by using $p_{bha}-p_{wh}$ instead of $\rho_{bha}$ for p and $TVD_{bha}$ for TVD in Equation (1).
- $\rho_{bha-dhpg}$: density calculated based on the hydrostatic difference between the BHA 26 and the downhole pressure gauge (DHPG). $\rho_{bha-dhpg}$ is obtained by using $\rho_{bha}$ instead of $p_1$ and $p_{dhpg}$ instead of $p_2$ with their respective TVDs in Equation (1).

Once the maximum coiled tubing depth or RIH time is reached, $i_2$ (out_gc_2) is determined together with $\rho_{2,1}$ and $\rho_{2,2}$ by best fit of the step-wise function represented in FIG. 4. From that point on, the automation output out_density_2 is $\rho_{2,2}$ and $p_{2,res}$ may be determined using Equation (3).

Method 3:

The reservoir pressure $p_{3,res}$ (Method 3) returned by the automation, once the maximum coiled tubing depth or RIH time is reached, is calculated as follows.

$$p_{3,res} = p_{dhpg} - 9.81 \times (TVD_{dhpg} - TVD_{res})\rho_{gu} \quad (6)$$

where $\rho_{gu}$ is an estimated fluid density. When BHA annular pressure is not available, only this method can provide an estimate of the reservoir pressure, but it requires an initial estimate (such as one provided by an engineer based on experience) of the density of the fluid below the interface. Equation (6) may be evaluated only once, at the end of the RIH.

Figure 6:
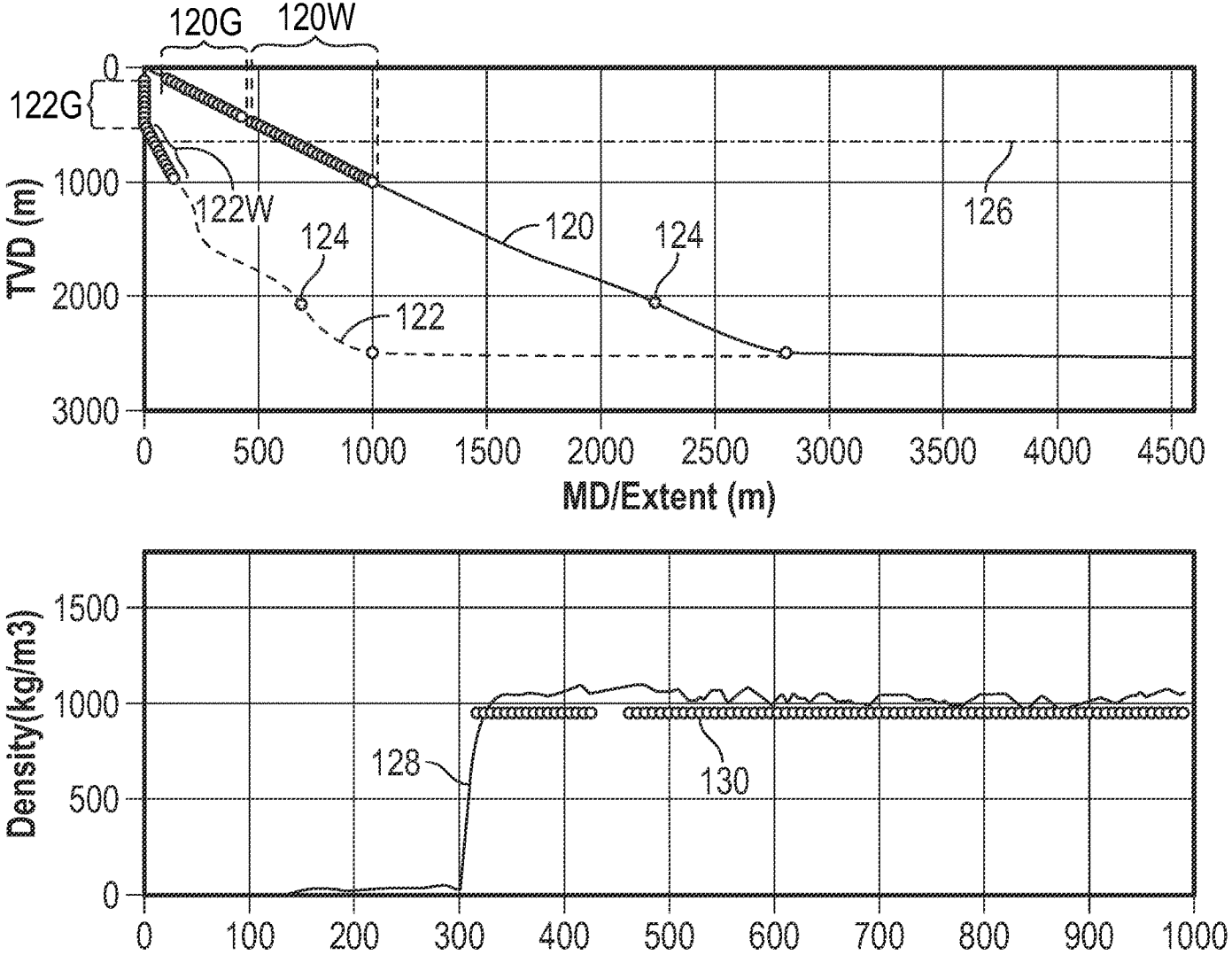
FIG. 6 shows the results of the interpretation automation of a coiled tubing cleanout operation for a run in a well, in accordance with embodiments of the present disclosure.
Figure 7:
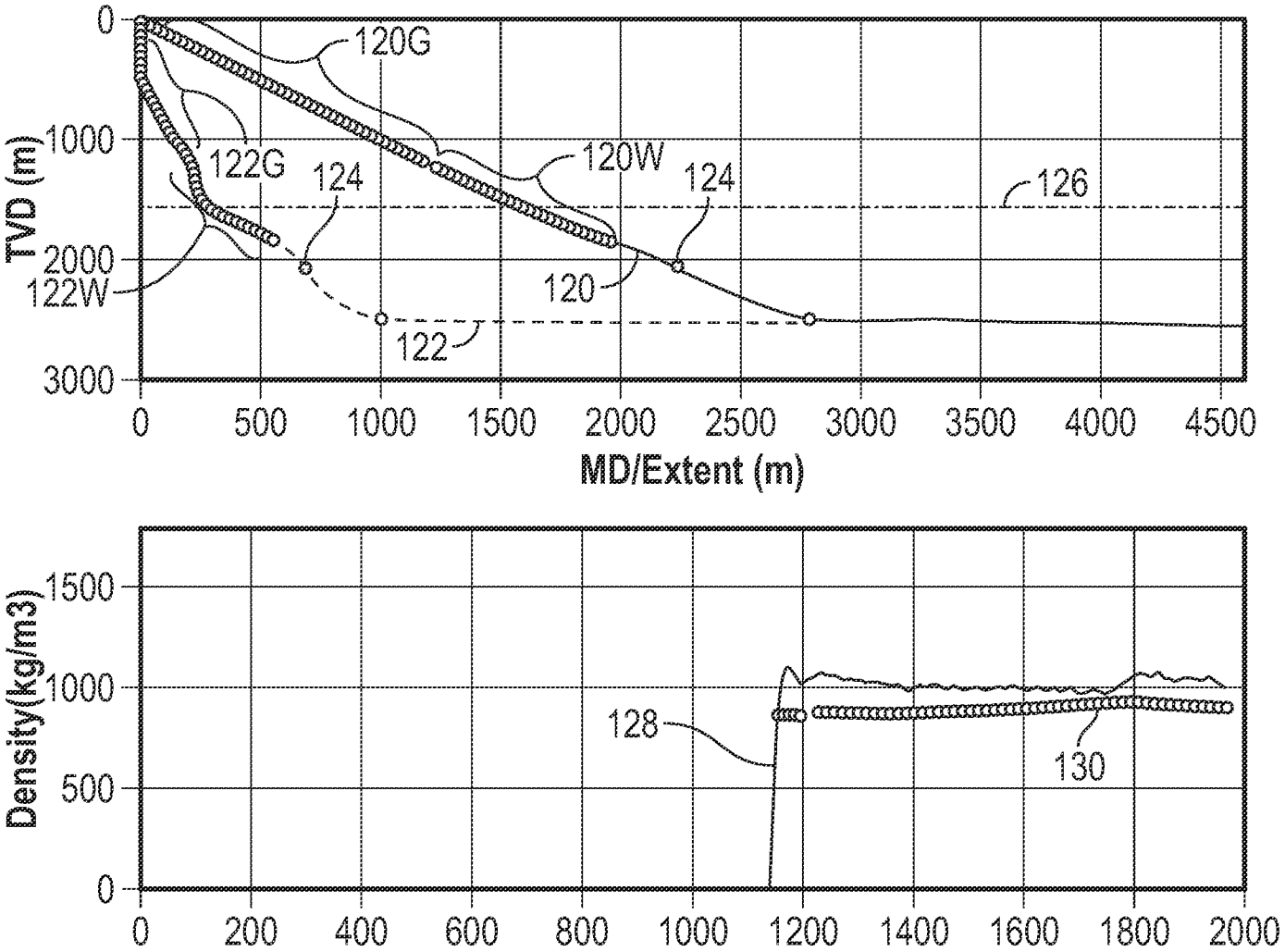
FIG. 7 shows the results of the interpretation automation of another coiled tubing cleanout operation for a run in a well, in accordance with embodiments of the present disclosure.

Two examples of implementation of the estimations described herein are illustrated in FIGS. 6 and 7.

Example 1

FIG. 6 shows the results of the interpretation automation of a coiled tubing cleanout operation for a run in a well. The upper portion of FIG. 6 illustrates true vertical depth (TVD) versus measured depth (MD-solid line) 120 and TVD versus lateral extent (dashed line) 122. First sets of data points 120G, 122G for each indicate that gas was detected, whereas second sets of data points 120W, 122W indicate that water was detected. The markers 124 indicate a position of a DHPG. The horizontal line 126 indicates a maximum gas cap depth. The lower portion of FIG. 6 illustrates a first density profile 128 (e.g., the solid line) calculated with Method 1 and a second density profile 130 (e.g., the symbols) below the gas cap calculated with Method 2. The final results from the example shown in FIG. 6 were as follows:

$$gc_{max} = 629 \text{ m}$$

Method 1: $p_{1,res}$=222 bars, $\rho_{1,1}$=37 kg/m3, $\rho_{1,2}$=1026 kg/m3, gc=304 m Method 2: $p_{2,res}$=219.1 bars, $\rho_{2,1}$=17 kg/m3, $\rho_{2,2}$=958 kg/m3, gc=304 m Method 3: $\rho_{3,res}$=221.4 bars ($\rho_{gu}$=1010 kg/m3)

Example 2

FIG. 7 shows the results of the interpretation automation of another coiled tubing cleanout operation for a run in a well. The same data elements are show in FIG. 7 as in FIG. 6. The final results from FIG. 7 were as follows:

$$gc_{max} = 1562 \text{ m}$$

Method 1: $p_{1,res}$=170 bars, $\rho_{1,1}$=1 kg/m3, $\rho_{1,2}$=1014 kg/m3, gc=1138 m Method 2: $p_{2,res}$=165 bars, $\rho_{2,1}$=8 kg/m3, $\rho_{2,2}$=895 kg/m3, gc=1138 m Method 3: $\rho_{3,res}$=170 bars ($\rho_{gu}$=1010 kg/m3)

While in the context of coiled tubing cleanout operations with reservoir pressures below hydrostatic pressure, there appears to be an interface between two fluids in the wellbore 14 after the well has been shut in, the methodology presented herein does not rely on either the presence of an interface or the reservoir 16 being below hydrostatic pressure. What the methodology does rely on is that:

During the initial RIH, prior to pumping, fluids do not flow along the wellbore 14 so that hydrostatic calculations may be made.

The stop criterion occurs when the fluid around the BHA 26 remains the same all the way down to the production interval.

If fluids start flowing too early, friction pressures may affect the accuracy of the methodology but, more importantly, the pressure extrapolation from the DHPG to the reservoir 16 may become inaccurate because of potential significant changes of fluid density with time (e.g. oil and gas inflow displacing initial water in the wellbore 14). In the case of a detected gas-oil interface, there is also a risk that the stop criterion occurs above a potential oil-water interface. In such an instance, the reservoir pressure would be estimated using the density of oil, while that of water should have been used. The embodiments described herein advantageously provides real-time refinement of optimal coiled tubing cleanout designs by using real-time downhole sensor data and inference algorithms.

Figure 8:
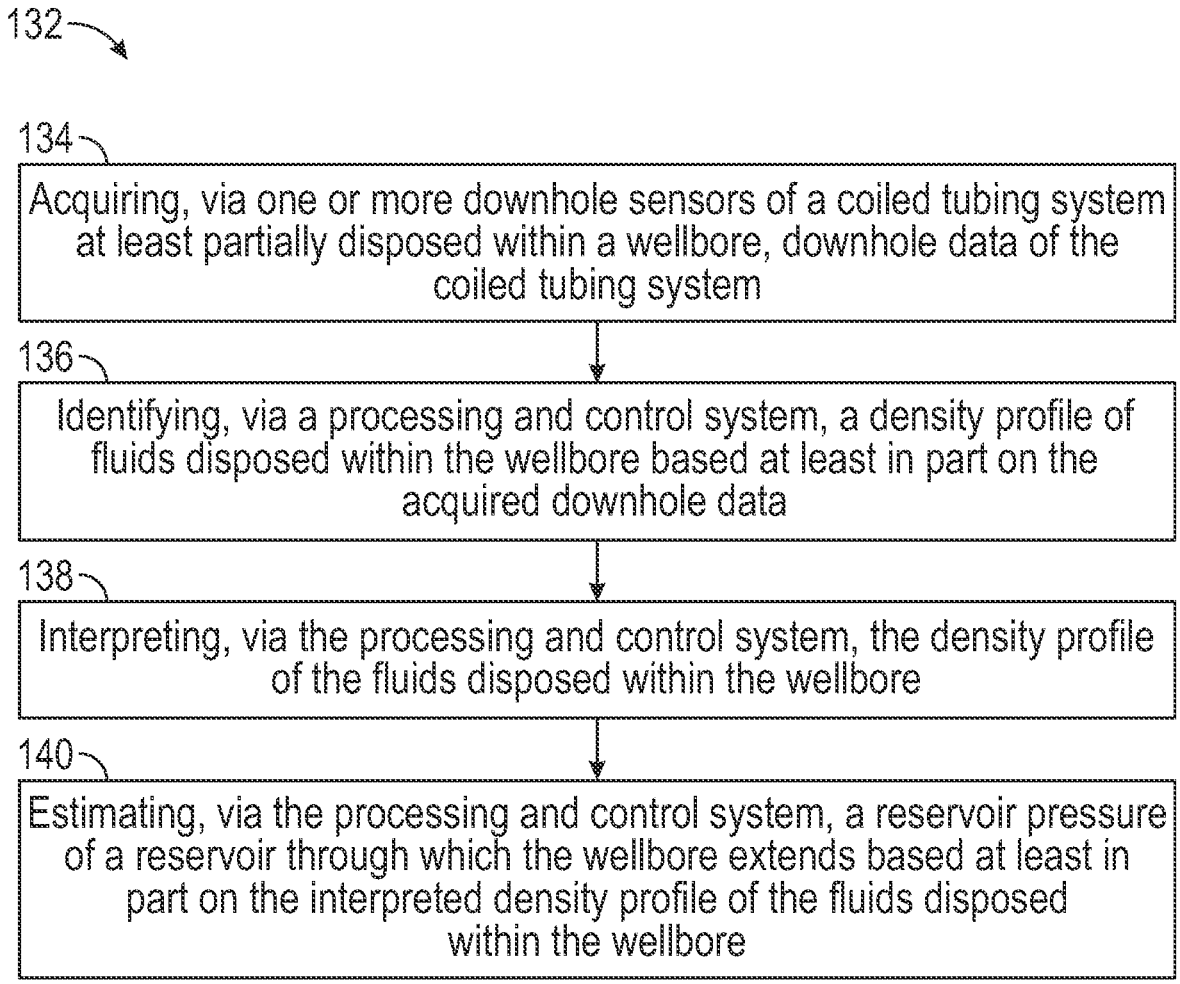
FIG. 8 is a flow diagram of a method for estimating reservoir pressure, in accordance with embodiments of the present disclosure.

FIG. 8 is a flow diagram of a method 132 for estimating reservoir pressure, as described in greater detail herein. For example, in certain embodiments, the method 132 may include acquiring, via one or more downhole sensors 40 of a coiled tubing system 10 at least partially disposed within a wellbore 14, downhole data of the coiled tubing system 10 (step 134). In addition, in certain embodiments, the method 132 may include identifying, via a processing and control system 42, a density profile 88 of fluids 82, 84 disposed within the wellbore 14 based at least in part on the acquired downhole data (step 136). In addition, in certain embodiments, the method 132 may include interpreting, via the processing and control system 42, the density profile 88 of the fluids 82, 84 disposed within the wellbore 14 (step 138). In addition, in certain embodiments, the method 132 may include estimating, via the processing and control system 42, a reservoir pressure of a reservoir 16 through which the wellbore 14 extends based at least in part on the interpreted density profile 90 of the fluids 82, 84 disposed within the wellbore 14 (step 140). In certain embodiments, the steps 134, 136, 138, 140 of the method 132 may be performed prior to a coiled tubing cleanout operation performed by the coiled tubing system 10 while the wellbore 14 is shut-in. In addition, in certain embodiments, the method 132 may include automatically adjusting, via the processing and control system 42, at least one adjustable operating parameter of the coiled tubing system 10 based at least in part on the estimated reservoir pressure.

In addition, in certain embodiments, the method 132 may include estimating, via the processing and control system 42, the reservoir pressure based at least in part on a downhole pressure acquired by a DHPG of the coiled tubing system 10, a TVD of the DHPG of the coiled tubing system 10, a TVD of a BHA 26 of the coiled tubing system 10, and the interpreted density profile 90 of the fluids 82, 84 disposed within the wellbore 14. In certain embodiments, the interpreted density profile 90 of the fluids 82, 84 disposed within the wellbore 14 may be determined as a function of a density measured by changes in the TVD of the BHA 26 of the coiled tubing system 10 during an initial RIH, a density measured by changes in the TVD of the BHA 26 of the coiled tubing system 10 during the initial RIH corrected by wellbore pressure variations, and a density measured by changes in the TVD of the BHA 26 of the coiled tubing system 10 during the initial RIH corrected by variations in the downhole pressure acquired by the DHPG of the coiled tubing system 10. In addition, in certain embodiments, the interpreted density profile 90 of the fluids 82, 84 disposed within the wellbore 14 may be determined as a function of a density measured by changes in the TVD of the BHA 26 of the coiled tubing system 10 during an initial RIH corrected by wellbore pressure variations, and a density calculated based at least in part on a hydrostatic difference between the BHA 26 of the coiled tubing system 10 and the DHPG of the coiled tubing system 10. In addition, in certain embodiments, the method 132 may include estimating, via the processing and control system 42, the reservoir pressure based at least in part on a downhole pressure acquired by a DHPG of the coiled tubing system 10, a TVD of the DHPG of the coiled tubing system 10, a TVD of a BHA 26 of the coiled tubing system 10, and an estimated fluid density when an annular pressure around the BHA 26 of the coiled tubing system 10 is not available.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A method, comprising:

acquiring, via one or more downhole sensors of a coiled tubing system at least partially disposed within a wellbore, downhole data of the coiled tubing system;

identifying, via a processing and control system, a density profile of fluids disposed within the wellbore based at least in part on the acquired downhole data;

interpreting, via the processing and control system, the density profile of the fluids disposed within the wellbore;

estimating, via the processing and control system, a reservoir pressure of a reservoir through which the wellbore extends based at least in part on the interpreted density profile of the fluids disposed within the wellbore; and estimating, via the processing and control system, the reservoir pressure based at least in part on a downhole pressure acquired by a downhole pressure gauge (DHPG) of the coiled tubing system, a true vertical depth of the DHPG of the coiled tubing system, a true vertical depth of a bottom hole assembly (BHA) of the coiled tubing system, and the interpreted density profile of the fluids disposed within the wellbore.

2. The method of claim 1, wherein the recited steps of the method are performed prior to a coiled tubing cleanout operation performed by the coiled tubing system while the wellbore is shut-in.

3. The method of claim 1, comprising automatically adjusting, via the processing and control system, at least one adjustable operating parameter of the coiled tubing system based at least in part on the estimated reservoir pressure.

4. The method of claim 1, wherein the interpreted density profile of the fluids disposed within the wellbore is determined as a function of a density measured by changes in the true vertical depth of the BHA of the coiled tubing system during an initial run in hole (RIH), a density measured by changes in the true vertical depth of the BHA of the coiled tubing system during the initial RIH corrected by wellbore pressure variations, and a density measured by changes in the true vertical depth of the BHA of the coiled tubing system during the initial RIH corrected by variations in the downhole pressure acquired by the DHPG of the coiled tubing system.

5. The method of claim 1, wherein the interpreted density profile of the fluids disposed within the wellbore is determined as a function of a density measured by changes in the true vertical depth of the BHA of the coiled tubing system during an initial run in hole (RIH) corrected by wellbore pressure variations, and a density calculated based at least in part on a hydrostatic difference between the BHA of the coiled tubing system and the DHPG of the coiled tubing system.

6. A processing and control system, comprising:

one or more processors configured to execute processor-executable instructions stored in memory media of the processing and control system, wherein the processor-executable instructions, when executed by the one or more processors, cause the processing and control system to:

identify a density profile of fluids disposed within a wellbore based at least in part on downhole data acquired via one or more downhole sensors of a coiled tubing system at least partially disposed within the wellbore;

interpret the density profile of the fluids disposed within the wellbore;

estimate a reservoir pressure of a reservoir through which the wellbore extends based at least in part on the interpreted density profile of the fluids disposed within the wellbore; and estimate the reservoir pressure based at least in part on a downhole pressure acquired by a downhole pressure gauge (DHPG) of the coiled tubing system, a true vertical depth of the DHPG of the coiled tubing system, a true vertical depth of a bottom hole assembly (BHA) of the coiled tubing system, and the interpreted density profile of the fluids disposed within the wellbore.

7. The processing and control system of claim 6, wherein the processor-executable instructions, when executed by the one or more processors, cause the processing and control system to perform the recited steps prior to a coiled tubing cleanout operation performed by the coiled tubing system while the wellbore is shut-in.

8. The processing and control system of claim 6, wherein the processor-executable instructions, when executed by the one or more processors, cause the processing and control system to automatically adjust at least one adjustable operating parameter of the coiled tubing system based at least in part on the estimated reservoir pressure.

9. The processing and control system of claim 6, wherein the interpreted density profile of the fluids disposed within the wellbore is determined as a function of a density measured by changes in the true vertical depth of the BHA of the coiled tubing system during an initial run in hole (RIH), a density measured by changes in the true vertical depth of the BHA of the coiled tubing system during the initial RIH corrected by wellbore pressure variations, and a density measured by changes in the true vertical depth of the BHA of the coiled tubing system during the initial RIH corrected by variations in the downhole pressure acquired by the DHPG of the coiled tubing system.

10. The processing and control system of claim 6, wherein the interpreted density profile of the fluids disposed within the wellbore is determined as a function of a density measured by changes in the true vertical depth of the BHA of the coiled tubing system during an initial run in hole (RIH) corrected by wellbore pressure variations, and a density calculated based at least in part on a hydrostatic difference between the BHA of the coiled tubing system and the DHPG of the coiled tubing system.

11. A method, comprising:

acquiring, via one or more downhole sensors of a coiled tubing system at least partially disposed within a wellbore, downhole data of the coiled tubing system prior to a coiled tubing cleanout operation performed by the coiled tubing system while the wellbore is shut-in;

identifying, via a processing and control system, a density profile of fluids disposed within the wellbore based at least in part on the acquired downhole data;

interpreting, via the processing and control system, the density profile of the fluids disposed within the wellbore;

estimating, via the processing and control system, a reservoir pressure of a reservoir through which the wellbore extends based at least in part on the interpreted density profile of the fluids disposed within the wellbore; and estimating, via the processing and control system, the reservoir pressure based at least in part on a downhole pressure acquired by a downhole pressure gauge (DHPG) of the coiled tubing system, a true vertical depth of the DHPG of the coiled tubing system, a true vertical depth of a bottom hole assembly (BHA) of the coiled tubing system, and the interpreted density profile of the fluids disposed within the wellbore.

12. The method of claim 11, comprising automatically adjusting, via the processing and control system, at least one adjustable operating parameter of the coiled tubing system based at least in part on the estimated reservoir pressure.

13. The method of claim 11, wherein the interpreted density profile of the fluids disposed within the wellbore is determined as a function of a density measured by changes in the true vertical depth of the BHA of the coiled tubing system during an initial run in hole (RIH), a density measured by changes in the true vertical depth of the BHA of the coiled tubing system during the initial RIH corrected by wellbore pressure variations, and a density measured by changes in the true vertical depth of the BHA of the coiled tubing system during the initial RIH corrected by variations in the downhole pressure acquired by the DHPG of the coiled tubing system.

14. The method of claim 11, wherein the interpreted density profile of the fluids disposed within the wellbore is determined as a function of a density measured by changes in the true vertical depth of the BHA of the coiled tubing system during an initial run in hole (RIH) corrected by wellbore pressure variations, and a density calculated based at least in part on a hydrostatic difference between the BHA of the coiled tubing system and the DHPG of the coiled tubing system.

* * * * *